US006716333B2

(12) United States Patent
Pearsall et al.

(10) Patent No.: US 6,716,333 B2
(45) Date of Patent: Apr. 6, 2004

(54) SPINNING ROTOR

(75) Inventors: Thomas J. Pearsall, Palm City, FL (US); Paul L. Lucas, Royal Palm Beach, FL (US); Robert D. Mackey, Greensboro, NC (US)

(73) Assignees: Ceramic Coatings Technologies, Inc., Palm City, FL (US); Burckhardt America, Incorporated, Greensboro, NC (US)

( * ) Notice: Subject to any disclaimer, the term of this patent is extended or adjusted under 35 U.S.C. 154(b) by 353 days.

(21) Appl. No.: 09/875,301

(22) Filed: Jun. 6, 2001

(65) Prior Publication Data

US 2002/0184964 A1 Dec. 12, 2002

(51) Int. Cl.[7] ..... C25D 11/00

(52) U.S. Cl. ..... 205/106; 205/107; 205/323; 205/324; 205/333; 205/325; 204/164; 57/414; 57/404; 74/572

(58) Field of Search ..... 205/333, 323, 205/324, 325, 106, 107; 204/164; 57/414, 404; 74/572

(56) References Cited

U.S. PATENT DOCUMENTS

| | | | | |
|---|---|---|---|---|
| 4,339,914 | A | | 7/1982 | Pfeifer |
| 4,502,273 | A | | 3/1985 | Miyamoto et al. |
| 5,616,229 | A | | 4/1997 | Samsonov et al. |
| 5,644,910 | A | * | 7/1997 | Ball et al. ..... 57/416 |
| 6,062,015 | A | | 5/2000 | Schürmann et al. |
| 6,123,989 | A | | 9/2000 | Schürmann et al. |
| 6,124,564 | A | | 9/2000 | Sue et al. |

* cited by examiner

*Primary Examiner*—Wesley A. Nicolas
(74) *Attorney, Agent, or Firm*—William L. Krayer

(57) ABSTRACT

A hard, wear-resistant ceramic surface is applied to spinning rotor cups in an electrolytic bath on which is imposed a shaped-wave electric current. A special electrode has been designed to facilitate application of the coating to the unique shape of a spinning rotor cup under the shaped wave conditions.

13 Claims, 3 Drawing Sheets

SPINNING ROTOR

TECHNICAL FIELD

This invention relates to textile spinning machines, particularly to an open-end spinning rotor cup having a superior hard and wear-resistant surface, and a method of making it by electrolytic deposition.

BACKGROUND OF THE INVENTION

Textile spinning machines commonly have as an important part an open end spinning rotor cup whose purpose is to collect fibers into strands and impart a twist to form a yarn. See the spinning rotor 9 described in Pfeifer's U.S. Pat. No. 4,339,014, issued in 1982, Lindner's U.S. Pat. No. 5,694,756 and Winzen's U.S. Pat. No. 5,987,871. As spinning machines have become more efficient and productive, the spinning rotors have been caused to rotate ever faster and to process greater and greater quantities of fiber. Workers in the art have had to continuously improve the surface hardness of the rotors to overcome the tendency of the surfaces to wear. While some early spinning rotors had rotational speeds of 30,000 rotations per minute (rpm), a contemporary competitive rotor will turn at the rate of 125,000 rpm or higher and process a wide variety of fibers. See the discussion of static and other problems caused by high rpm, at least with some materials, as described by Coenen in U.S. Pat. No. 6,006,510. The fiber sliding wall, collecting groove and adjacent annular surface of the spinning rotor are subject to continual wear (see the discussion in Wassenhoven's U.S. Pat. No. 6,047,538), and have been covered with various coatings to prolong the life of the rotor. The problem persists, however, as the machines are pushed to ever higher production rates.

Rotor elements were initially fabricated from aluminum or aluminum alloys, primarily because of the light weight of the aluminum, which is considered desirable for the lesser inertia to overcome during braking. A good review of the braking problem may be found in Wassenhoven et al U.S. Pat. No. 5,964,084; see also U.S. Pat. No. 5,987,872. But unprotected aluminum soon gave way in the past to hardcoat anodizing, and this in turn was found deficient as greater production demands necessitated a more durable material. Because of the difficulty of finding an improved surface for aluminum, workers turned to steel in spite of its greater density and weight. Miyamoto et al, in U.S. Pat. No. 4,502,273 describe thermally hardening selected areas of the rotor using a laser beam.

Thermal hardening of the steel facilitated coating of the steel with nickel to improve wear resistance, but in spite of constantly improving rotor specifications, wear was not eliminated. Some workers in the art attempted to return to aluminum with various ceramic coatings generally applied by thermal spraying processes. While some of these coatings have been successful, adherence of the coating to aluminum is difficult to achieve. Even if the application of a thermally sprayed coating is successful, subsequent finishing to achieve a smooth surface so as to allow proper fiber and/or yarn contact and acceptable composition in the finished product is a costly and difficult process.

The reader may be interested in the ceramic cap described for a navel used in combination with the rotor, in Mackey et al U.S. Pat. Nos. 5,437,147 and 5,475,974.

Contemporary machines commonly use rotor speeds in the range of 120,000 to 125,000 rpm; many of the rotors are made of steel, with composite diamond coatings, boride treatments with zinc or nickel overcoats, and/or, finally, steel rotor elements with boride treatment and composite diamond overcoating. See Schuermann et U.S. Pat. Nos. 6,062,015 and 6,123,989; a coating method is described in the latter patent.

In view of the preference of the industry for a light weight rotor, an aluminum rotor is needed having surface protection effective for long periods at high rpm's.

SUMMARY OF THE INVENTION

We have developed a new hard, wear-resistant spinning rotor. The present invention provides an improved open-end spinning rotor element providing a lightweight rotor cup protected from wear on its critical surfaces by a ceramic material, preferably of a particular composition. The rotor cup element comprises an aluminum body and a ceramic layer over substantially its entire surface or selected portions of the surface, especially the internal surface. The ceramic layer is formed by conversion of the aluminum surface to a hard, wear resistant ceramic by a microarc oxidation process employing an electrolyte and controlled high voltage alternating current to create a plasma discharge at the interface between the aluminum rotor element and the electrolyte.

In U.S. Pat. No. 5,616,229, Samsonov and Hiterer propose the formation of ceramic coatings of up to 300 microns thick within about 90 minutes through the use of an alternating current of at least 700 volts having a shaped wave (not the conventional sinusoidal form) which rises from zero to its maximum height and falls to below 40% of its maximum height within less than a quarter of its full alternating cycle, thereby causing dielectric breakdown, the alternating current being imposed on an electrolytic bath in which the metal subject is an electrode, the bath comprising initially an alkali metal hydroxide and in a later step including an oxyacid salt of an alkali metal, such as sodium tetrasilicate. While the '229 patent speaks of forming coatings on aluminum surfaces, the authors do not treat the possible use of such a coating process for application to the unique contours of aluminum spinning rotors.

The oxide ceramic coatings utilized according to this invention on the surface of spinning rotors exhibit surface hardnesses of at least 1000 $Kn_{100}$ and preferably 1300 $Kn_{100}$ or more, and a density greater than 90% of theoretical, preferably greater than 97%, and a surface roughness after finishing that ranges from 4 to 60 Ra. While aluminum spinning rotor cups are preferred in our invention, we may also use spinning rotors fabricated from titanium, magnesium, beryllium, hafnium, zirconium, and alloys of these with or without aluminum, prepared with coatings of the hardnesses and densities described above.

We use a modified shaped-wave electrolytic process to form a hard coating on the spinning rotor. The process may use the teachings of U.S. Pat. No. 5,616,229 and accordingly that patent is hereby incorporated by reference, in its entirety, into this disclosure. However, the '229 patent uses two distinct electrolytic baths for the substrates discussed, and we have found it is not necessary to do so for spinning rotors, particularly of aluminum.

Our method comprises forming a hard coating on the incipient spinning rotor cup by immersing it first in an electrolytic bath comprising (deionized) water, an alkali metal salt or hydroxide (preferably potassium hydroxide) as an electrolytic agent, at a concentration of 0.5–7 grams per liter, and, as a passivating agent, a colloidal suspension of sodium silicate in the form $Na_2O{\cdot}xSiO_2$ (x=>2.55 by weight) at a concentration of 2.0–9.5 grams per liter while conducting through the bath a modified shaped-wave alternating electric current from a source of at least 250–800 volts through the surface of the incipient spinning rotor cup. The modified shaped-wave electric current rises from zero to its maximum height and falls to below 40% of its maximum height (amplitude) within less than a quarter of a full alternating cycle, thereby causing dielectric breakdown and the formation of a compact ceramic film on the spinning rotor surface.

Thus our invention is seen to include a method of forming a hard ceramic surface on a selected portion of the internal annular surface of a spinning rotor cup comprising (a) placing the spinning rotor cup in an electrolyte bath containing ingredients capable of forming a hard ceramic surface by electrolysis (b) connecting the spinning rotor cup to a source of electric current (c) placing an electrode inside the spinning rotor cup, said electrode being shaped and placed to provide a peripheral terminus substantially peripherally equidistant from the selected portion of internal annular surface, and (d) passing a current through the electrode, the bath, and the rotor cup sufficient to form a hard ceramic coating on the selected internal annular or other surface.

We have developed a special electrode for use in the process, and deploy it in the bath in a particular manner with respect to the spinning rotor cup in order to direct the flow of electrical current to those surfaces subject to a high degree of wear during operation of the spinning rotor.

Thus our invention includes making a wear-resistant spinning rotor cup comprising forming a hard coating on an interior surface of an incipient spinning rotor cup by (i) immersing the incipient spinning rotor in an electrolytic bath comprising a passivating agent and an electrolytic agent, and (ii) passing a modified shaped-wave alternating electric current from a source of 250 to 800 volts through the interior surface of said incipient spinning rotor, wherein the modified shaped-wave electric current rises from zero to its maximum height and falls to below 40% of its maximum height within less than a quarter of a full alternating cycle thereby causing dielectric breakdown and the formation of a ceramic coating on the interior surface, and removing the incipient spinning rotor cup from the electrolytic bath. Preferably, the electrode will have a peripheral terminus and be positioned centrally within the incipient spinning rotor cup so that the terminus is peripherally substantially equidistant from the at least one selected portion of the interior surface of the incipient spinning rotor cup.

DETAILED DESCRIPTION OF THE INVENTION

The electrolytic treatment of the incipient spinning rotor cup will generally take about 30 to about 240 minutes to form a ceramic coating of 25 to 300 microns (0.001 to 0.012 inch) thick. A preferred thickness for the coating at the thickest part, which is preferably in the collection groove, is 75 to 150 microns (0.003 to 0.006 inches) thick. During the process cycle the substrate temperature is preferably maintained at less than 60° C. (140° F.). The incipient blank spinning rotor cup will preferably have an aluminum surface, but it may be made of aluminum, magnesium, titanium, zirconium, beryllium, hafnium or alloys thereof.

The coating process can utilize a single electrolytic bath comprising water and a solution of an alkali metal hydroxide concentrated at 0.5 to 2 grams per liter, a second bath containing water, a solution of alkali metal hydroxide (0.5 to 2 grams per liter) and a low concentration (1 to 2 grams per liter) of sodium tetrasilicate, and a third bath containing water, an alkali metal hydroxide concentrated at 0.5 to 5 grams per liter and a 1 to 5 grams per liter concentration of sodium tetreasilicate.

However, a preferred method of coating is to utilize a single bath wherein the electrolyte solution comprises deionized water, potassium hydroxide concentrated at 0.5–7 grams per liter and a colloidal suspension of sodium silicate in the form $Na_2O{\cdot}xSiO_2$ (x=>2.55 by weight). The spinning rotor cup to be coated comprises one electrode, and the container for the electrolyte, or a base fixture for holding the spinning rotor cup, comprises the other electrode. A modified shaped-wave charge of at least 250 volts is passed through the surface of the incipient spinning rotor cup causing dielectric breakdown and formation of a compact ceramic film on the surface of the spinning rotor cup. The ceramic thus formed comprises aluminum and silicon oxides, the composition (oxide content and proportions of Al and Si) of which may vary somewhat as influenced by the substrate metal and the conditions of formation. Although the alternating current flows in both directions, the ceramic is formed only on the spinning rotor cup, which is preferably of aluminum or at least an aluminum surface, or titanium, magnesium or zirconium, but not steel.

Figure 1A:
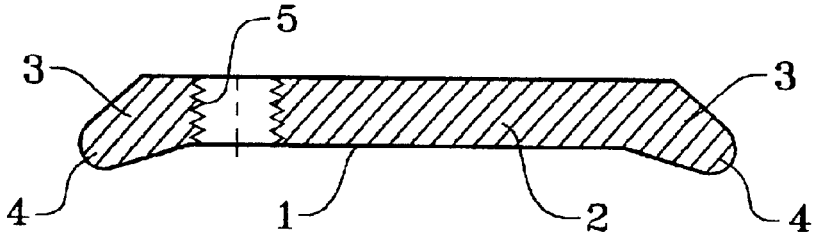
FIGS. 1*a* and 1*b* are sectional and overhead views of our electrode.
Figure 1B:
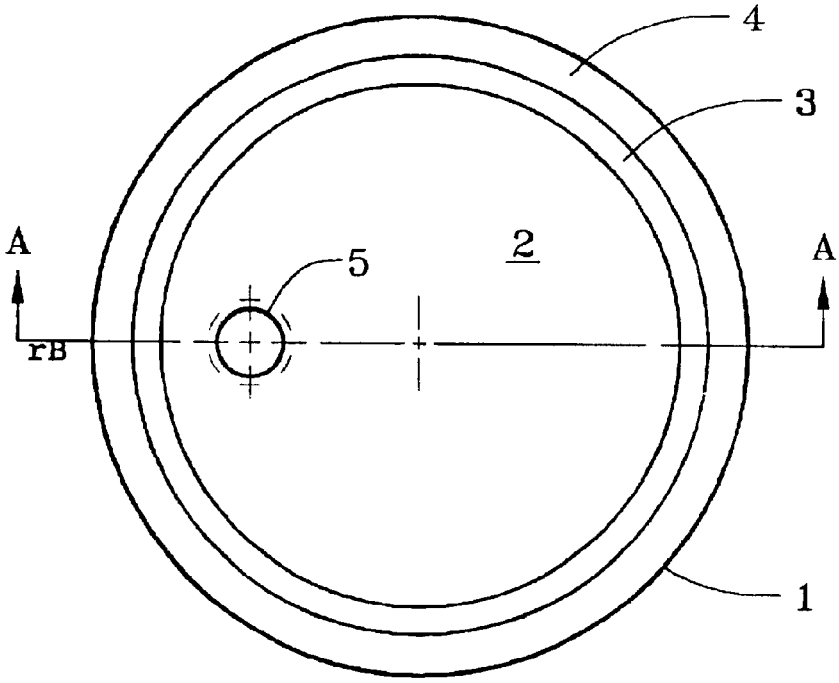

Referring now to FIGS. 1*a* and 1*b*, electrode 1 is seen to be generally disc-shaped, having a substantially flat body 2 surrounded by a downwardly oriented flange 3 having a rounded edge 4. The electrode is preferably made of stainless steel, but may be of any metal or other conductive material which will not become coated with the ceramic. As seen in FIGS. 1*a* and 1*b*, the downwardly oriented flange 3 extends around the entire periphery of the body 2. An aperture 5 may be provided for a connector to the alternating current circuit.

Figure 2:
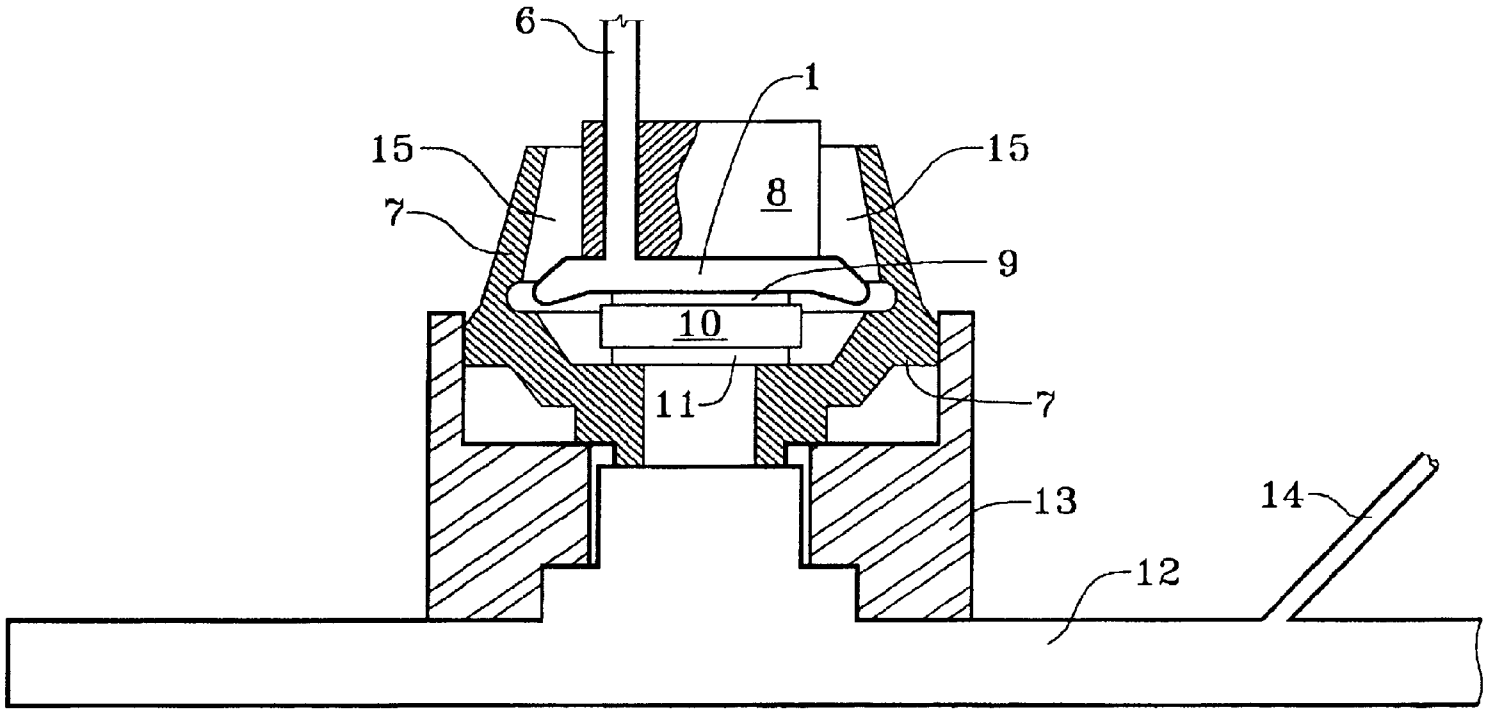
FIG. 2 shows the disposition of the electrode within the spinning rotor cup as used in the electrolytic bath.

In FIG. 2, the electrode 1, connected to alternating current connector 6, is disposed centrally within spinning rotor cup 7 so that the flange 3 and rounded edge 4 (see FIGS. 1*a* and 1*b*) are concentric with all interior surfaces of rotor cup 7. Insulator 8 protects the top surface of electrode 1 and the alternating current connector 6 from the electrolyte bath (not shown) in which the entire assembly is submerged. O ring 9, spacer insulator 10, and O ring 11 isolate the bottom surface of the electrode 1 from the bath and help to position the electrode 1 vertically within the rotor cup 7. Holding fixture 12 and positioning fixture 13 are designed to place the assembly in the bath; holding fixture 12 also contains alternating current connector 14, which is connected internally with the rotor cup 7 to complete the circuit through the bath. The electrolyte bath (not illustrated) fills the cavity 15 within the rotor cup and conducts the alternating current between the rotor cup 7 and the electrode 1.

Figure 3:
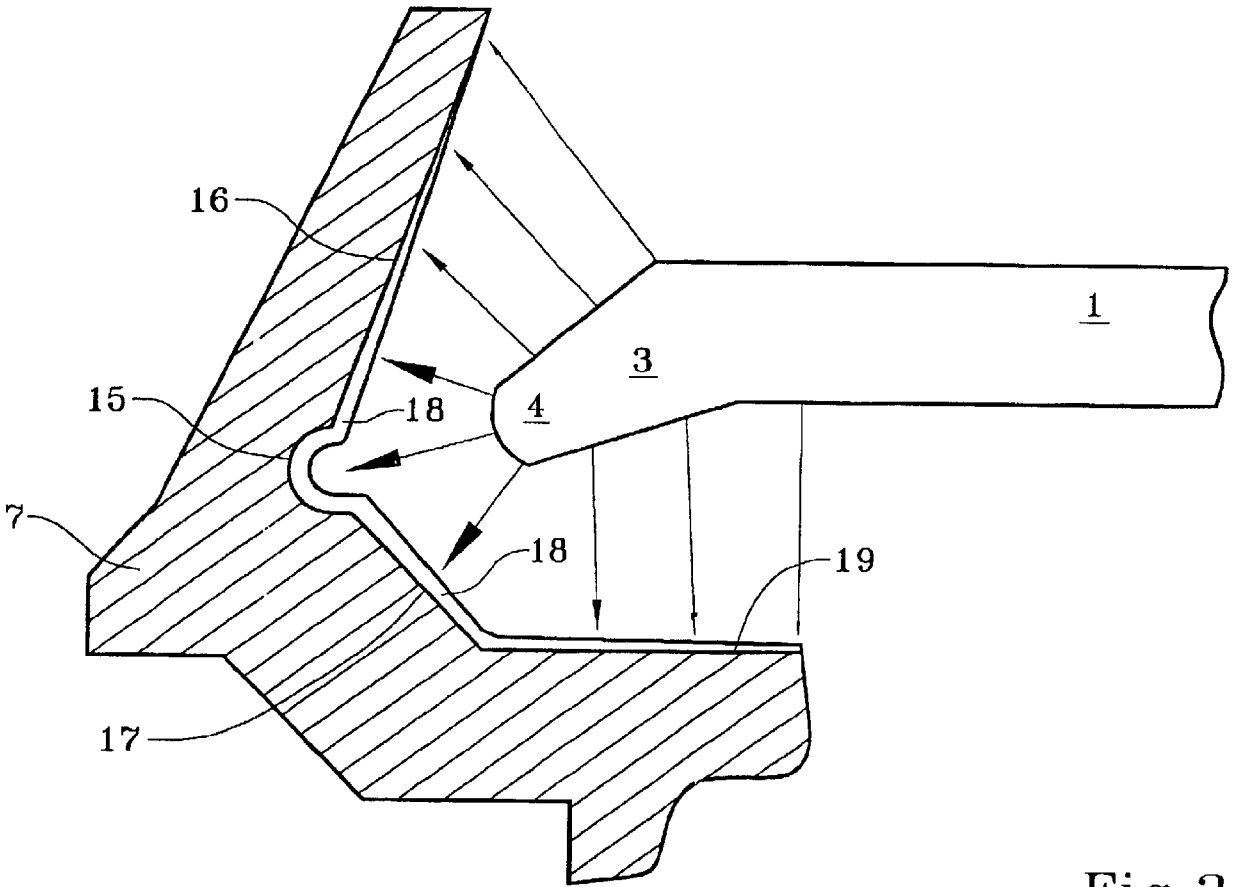
FIG. 3 is an enlarged section of the electrode and spinning rotor cup, illustrating the flow of current within the bath.

An enlarged view of the disposition of the electrode 1 within rotor cup 7 is seen in FIG. 3, in which the flange 3 is oriented generally downwardly and rounded edge 4 is oriented to "aim" at the collection groove 15 of the rotor cup. The most current will flow towards the collection groove 15 from the rounded edge 4 because of its shape and position close the collection groove 15. Slightly less current will flow towards the upper face 16 of the sliding wall of the rotor cup 7 and the lower face 17 of the sliding wall of the rotor cup 7. Thus the downward orientation of the flange 3 results in a gradual widening of the space between the electrode 1 and the two surfaces above and below it, the upper face 16 of the sliding wall above collection groove 15 and the lower face 17 of the sliding wall below the collection groove 15 and the annular floor 19. This results in a high concentration of current flowing towards collection groove 15 and lower concentrations of current elsewhere, as illustrated by the arrows, further resulting in a tapered cross section of thickness of ceramic coating 18 as shown. As is most desirable, the ceramic coating 18 is thickest in the collection groove 15, which is most subject to wear, and tapers to a thinner coating in the upper face 16 and the lower face 17 of the sliding wall and annular floor 19. Succinctly, our invention provides a thick coating of ceramic, preferably 75 to 150 microns thick, in the collection groove without depositing a coating of a similar thickness where it is not needed.

Voltages greater than 800 are unnecessary to the formation of the ceramic and voltages in excess of 800 are not recommended because they will overheat the electrolytic solution. Voltages less than 250 are not recommended because uniform breakdown of the electrolyte will not occur and film growth rates will not be efficient or uniform. Amperages and cycles are more or less conventional—100 amperes per square foot of treated surface is adequate and 50–70 cycles per second is satisfactory.

The electrolytic fluid is an aqueous solution comprising 2 to 60 or more grams per liter, preferably 2 to 15 grams per liter, of a passivating agent comprising a soluble silicate, polyphosphate, chromate, molybdate, vanadate, tungstate or aluminate salt, the preferred passivating agent being sodium silicate ($Na_2SiO_3$) in the form of a colloidal suspension, and, as an electrolytic agent, 0.5 to 3 grams per liter of a strong acid, strong alkali or strong acid or alkaline salt; suitable electrolytic agents are $H_2SO_4$, KOH, NaOH, NaF, $Na_2SO_4$, $H_3PO_4$, and $NaPO_4$, the preferred electrolytic agent being KOH. Any known or commercially used passivating agent may be used, such as $Na_2SiO_3$, $K_2SiO_3$, $Na_6P_6O_{18}$, $Na_2Cr_2O_2$, $Na_2Cr_2O_7$, $Na_2Mo_2O_7$, $K_2Cr_2O_7$, $Na_2V_2O_7$, $K_2V_2O_7$, $Na_2WO_4$, $K_2WO_4$ and $KAlO_2$.

Following is an exemplary procedure for the manufacture of a spinning rotor cup of our invention.

Fabrication of the spinning rotor cup is accomplished in accordance with conventional machining and/or grinding practices to at or near the final dimensions specified. The substrate material is preferably aluminum, but may be titanium, magnesium, hafnium, zirconium, beryllium or alloys thereof.

The fabricated spinning rotor cup blank is cleaned of surface contaminants by any suitable method.

The fabricated blank spinning rotor cup is attached with the shaped electrode properly positioned to a fixture or mechanism such that it may be immersed in an aqueous electrolyte bath containing an electrolytic agent and a passivating agent. As described elsewhere herein, the spinning rotor cup and the electrode are placed in the electrolyte as illustrated and each is connected to an alternating current power source. The electrode is connected to the power source such that a modified shaped-wave electric current of at least 250 volts is conducted through the surface of the spinning rotor cup, causing dielectric breakdown and the formation of a compact oxide ceramic film on the spinning rotor cup surface. The spinning rotor remains in the electrolyte, connected to the voltage source, for a predetermined time period, usually from about 30 minutes to about 240 minutes, sufficient to allow formation of an oxide ceramic film of from 25 microns (0.001 inch) to 300 microns (0.012 inch) thick, preferably 75 to 150 micorns (0.003 to 0.006 inches) thick. Formation of the oxide ceramic film does not substantially increase the dimension of the spinning rotor cup.

Upon completion of the coating formation cycle, the spinning rotor cup is removed from the electrolyte container, the fixturing devices and shaped electrode are removed and the spinning rotor cup may be microfinished such that a suitably smooth finish of about 4 to 60 micro-inches Ra, preferably 18 to 25 micro-inches Ra, is achieved.

Surface roughness measurements described herein in Ra units reflect the average surface roughness measured in micro-inches according to ANSI Method B46.1.

We prefer to perform process steps in addition to those recited above. In particular, we believe it is advantageous to perform the following steps to make a spinning rotor cup of high quality:

1. The blank spinning rotor cup, having a metal surface such as described above, as received from the manufacturer or after having been manufactured in house, is cleaned to remove whatever contaminants may be present on the surface;
2. The surface is converted to a ceramic by the procedure described above.

During the electrolytic process, some of the aluminum or other metal on the surface is converted to an oxide such as $Al_2O_3$; some $SiO_2$ is incorporated into the surface of the spinning rotor cup. Temperatures at the surface during dielectric breakdown reach over 10,000° F. and as high as 30,000° F., and the oxide is substantially welded to the aluminum substrate. Each spark or waveform creates a spark and/or dielectric breakdown causing such high temperatures. The ceramic will tend to have a crystalline structure which will vary with the particulars of the conditions and materials used. We call the coating an "oxide ceramic" coating. It is believed the oxygen which combines with the aluminum or other substrate material is contributed by the electrolytic agent from strong acids, strong alkalis or strong salts such as $H_2SO_4$, KOH, NaOH, NaF, $Na_2SO_4$, $H_3PO_4$, and $NaPO_4$, the preferred electrolytic agent being KOH.

3. The spinning rotor cup is then inspected for dimensional conformance.
4. The oxide ceramic surface is then polished to a surface roughness of about 4 to 60 micro-inches Ra; preferably 18 to 25 micro-inches Ra is achieved. As is known in the art, varying degrees of roughness/smoothness may affect the physical properties of textiles, and our invention includes the ability to imbue specific areas of the spinning rotor with selected surface roughness characteristics.

What is claimed is:

1. Method of making a wear-resistant spinning rotor cup comprising forming a hard coating on an interior surface of an incipient spinning rotor cup by (i) immersing said incipient spinning rotor in an electrolytic bath comprising a passivating agent and an electrolytic agent, wherein said passivating agent comprises a colloidal suspension of sodium silicate in the form $Na_2O{\cdot}xSiO_2$ (x=>2.55 by weight), and (ii) passing a modified shaped-wave alternating electric current from a source of 250 to 800 volts through said interior surface of said incipient spinning rotor, wherein said modified shaped-wave electric current rises from zero to its maximum height and falls to below 40% of its maximum height within less than a quarter of a full alternating cycle thereby causing dielectric breakdown and the formation of a ceramic coating on said interior surface, and removing said incipient spinning rotor cup from said electrolytic bath.

2. Method of claim 1 wherein said current is passed through an electrode positioned within said incipient spinning rotor cup to cause said formation of a ceramic coating on at least one selected portion of said interior surface.

3. Method of claim 2 wherein said electrode has a peripheral terminus and is positioned centrally within said incipient spinning rotor cup so that said terminus is peripherally substantially equidistant from said at least one selected portion of said interior surface of said incipient spinning rotor cup.

4. Method of claim 1 wherein said passivating agent comprises a colloidal silicate.

5. Method of claim 1 wherein said electrolytic agent comprises an alkali metal hydroxide.

6. Method of claim 1 wherein said incipient spinning rotor cup has an aluminum surface.

7. Method of claim 1 wherein said passivating agent is at a concentration of 2.0–9.5 grams per liter of said bath, said electrolytic agent is an alkali metal hydroxide, and said spinning rotor cup has an aluminum surface.

8. Method of forming a hard ceramic surface on at least a portion of the surface of a collection groove of a spinning rotor cup comprising (a) placing said spinning rotor cup in an electrolyte bath containing ingredients capable of forming a hard ceramic surface by electrolysis (b) connecting said spinning rotor cup to a source of electric current (c) placing an electrode inside said spinning rotor cup, said electrode being shaped and placed to provide a peripheral terminus substantially peripherally equidistant from said portion of said collection groove surface, and (d) passing a current through said electrode, said bath, and said rotor sufficient to form a hard ceramic coating on said portion of said surface of said collection groove surface.

9. Method of claim 8 wherein said current is a modified shaped-wave alternating current.

10. Method of claim 8 wherein said incipient spinning rotor cup has an aluminum surface.

11. Method of claim 8 wherein said electrolytic agent is an alkali metal hydroxide present in a concentration of 0.5 to 2 grams/liter.

12. Method of forming a hard ceramic surface on a selected portion of the internal annular surface of a spinning rotor cup comprising (a) placing said spinning rotor cup in an electrolyte bath containing ingredients capable of forming a hard ceramic surface by electrolysis (b) connecting said spinning rotor cup to a source of electric current (c) placing an electrode inside said spinning rotor cup, said electrode comprising a body and a downwardly oriented peripheral flange and being shaped and placed to provide a peripheral terminus substantially peripherally equidistant from said selected portion of internal annular surface, and (d) passing a current through said electrode, said bath, and said rotor sufficient to form a hard ceramic coating on the surface of said selected internal annular surface.

13. Method of forming a hard ceramic surface on a selected portion of the internal annular surface of a spinning rotor cup comprising (a) placing said spinning rotor cup in an electrolyte bath containing ingredients capable of forming a hard ceramic surface by electrolysis, said ingredients including about 2 to about 15 grams per liter of sodium silicate of the formula $Na_2O{\cdot}xSiO_2$ (x=>2.55 by weight), (b) connecting said spinning rotor cup to a source of electric current (c) placing an electrode inside said spinning rotor cup, said electrode being shaped and placed to provide a peripheral terminus substantially peripherally equidistant from said selected portion of internal annular surface, and (d) passing a current through said electrode, said bath, and said rotor sufficient to form a hard ceramic coating on the surface of said selected internal annular surface.

* * * * *